US005430896A

United States Patent [19]

Bisley

[11] Patent Number: 5,430,896

[45] Date of Patent: Jul. 11, 1995

[54] WATER RESISTANT SOCK

[76] Inventor: Bill D. Bisley, 40 Carabob Court, Apt. 1107, Scarborough, Ontario, Canada, M1T 3N3

[21] Appl. No.: 100,259

[22] Filed: Aug. 2, 1993

[51] Int. Cl.[6] ..... A41B 11/00; A43B 17/00

[52] U.S. Cl. ..... 2/239; 2/272

[58] Field of Search ..... 2/239, 2, 87, 272, DIG. 1, 2/DIG. 5, 164, 167, 243.1; 36/9 R, 10, 84, 7.1 R

[56] References Cited

U.S. PATENT DOCUMENTS 4,809,447 3/1989 Pacanowsky et al. ..... 2/239

5,159,719 11/1992 Aumann ..... 2/87

*Primary Examiner*—Clifford D. Crowder

*Assistant Examiner*—Amy B. Vanatta

[57] ABSTRACT

A water (and other moisture) resistant sock looks and feels like a regular sock but actually has a water resistant or water proof layer between two non water resistant or non water proof layers. The layers are preferably spaced slightly apart from each other by means of small spacers to better allow the sock to breathe.

4 Claims, 3 Drawing Sheets

WATER RESISTANT SOCK

BACKGROUND OF THE INVENTION

1. Field of the Invention

The present invention relates generally to clothing, and more particularly, to a sock especially adapted to be water resistant.

2. Description of the Prior Art

The use of foot socks is well known in the clothing art. It is also known to provide socks which try to remove wetness (perspiration) away from the foot (for example, see U.S. Pat. No. 4,898,007 which discloses a moisture management sock with its toe and heel portions knit predominately, or entirely, of hydrophilic yarn while the instep portion is knit of hydrophobic yarn so that moisture absorbed from the wearer's foot by the hydrophilic yarn is transferred by wicking action into the hydrophobic yarn in the instep portion to be evaporated). Other examples of socks are shown in the following U.S. Pat. Nos. 3,457,566; 3,562,818; 4,15 1,660; 4,194,249; and 4,255,949.

Thus, while the foregoing body of prior art indicates it to be known to provide socks intended to remove wetness from feet, the provision of a simple and cost effective sock for keeping wetness from reaching the foot while allowing the foot to breathe is not contemplated. Nor does the prior art described above teach or suggest a sock which may be used by individuals in inclement weather to keep their feet both warm and dry. The foregoing disadvantages are overcome by the unique water resistant sock of the present invention as will be made apparent from the following description thereof. Other advantages of the present invention over the prior art also will be rendered evident.

SUMMARY OF THE INVENTION

To achieve the foregoing and other advantages, the present invention, briefly described, provides a water (and other moisture) resistant sock which looks and feels like a regular sock but actually has a water resistant or water proof layer between two non water resistant or non water proof layers. The layers are preferably spaced slightly apart from each other by means of small spacers to better allow the sock to breathe.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new water resistant sock which has all of the advantages of the prior art and none of the disadvantages. It is another object of the present invention to provide a new water resistant sock which may be easily and efficiently manufactured and marketed.

It is a further objective of the present invention to provide a new water resistant sock which is of durable and reliable construction.

An even further object of the present invention is to provide a new water resistant sock which is susceptible of a low cost of manufacture with regard to both materials and labor, and which accordingly is then susceptible of low prices of sale to the consuming public, thereby making such water resistant sock available to the buying public.

Still yet a further object of the present invention is to provide a new water resistant sock having a water resistant or water proof layer of material between layers of non water resistant or non water proof materials.

It is still a further object of the present invention is to provide a new water resistant sock in which the layers of material are slightly separated to better allow the sock to breathe.

Still a further object of the present invention is to provide a new water resistant sock including means for keeping the layers of material spaced apart.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved water resistant sock embodying the principles and concepts of the present invention will be described.

Figure 1:
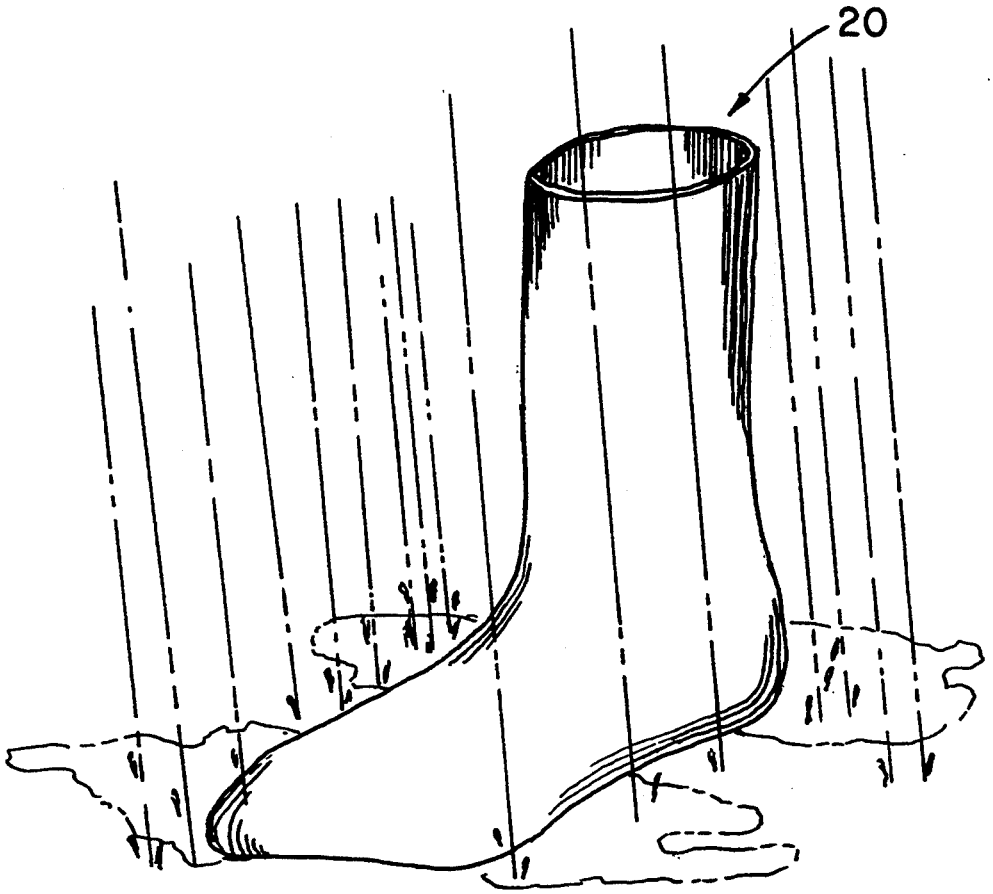
FIG. 1 is a perspective view showing the first preferred embodiment of the water resistant sock of the present invention.
Figure 2:
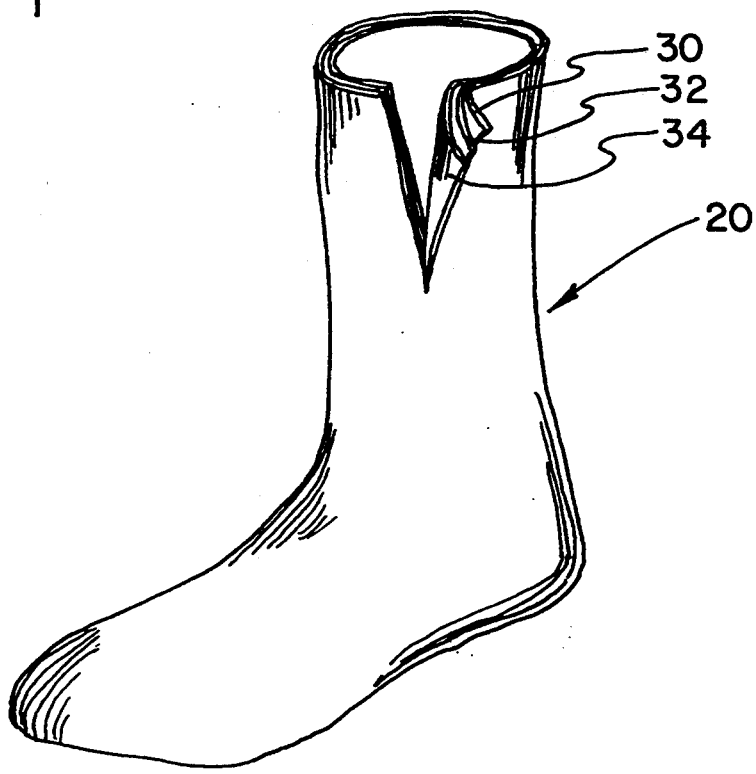
FIG. 2 is a perspective view of the water resistant sock of FIG. 1 with a section cut open to reveal the layered structure in accordance with the present invention.

Turning initially to FIGS. 1 and 2, there is shown a first exemplary embodiment of the water resistant sock of the invention generally designated by reference numeral 20. In its preferred form, water resistant sock 20 comprises generally three layers 30, 32 and 34. The inner layer 30 and outer layer 34 are made of a typically non water (or other moisture) proof and non water (or other moisture) resistant material such as and preferably a typical sock material such as cotton or wool or polyester or blends thereof. The middle layer 32 is preferably made of a water (and other moisture) resistant and/or proof material such as GORE-TEX or any other suitable material. The three layers can be sewn together or glued together.

The middle water resistant layer 32 provides protection against moisture. The inner layer 34, which is protected from getting wet by the water resistant layer 32, provides the wearer with warmth (since it is dry) and with the normal comfortable feel of a regular sock since it is preferably made of a normal sock material such as cotton or wool or polyester or blends thereof. The outer layer 30 provides the appearance of a regular sock since it is preferably made of a regular sock material like the inner layer 34. The outer layer 30 can be dyed virtually any color as is desired. While the outer layer 30 does not provide a barrier against moisture, the middle layer 32 does. Moisture will not be able to pass through the middle layer 32. Moisture which is trapped initially trapped in the outer layer 30 will eventually evaporate out (quickly if a material like wool is used for the outer layer 30).

Figure 3:
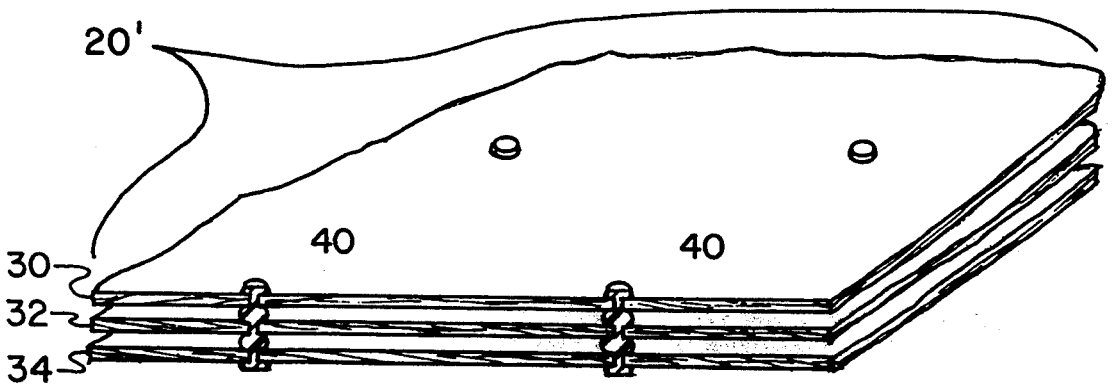
FIG. 3 is a cross-sectional view of a section of a second embodiment of a water resistant sock utilizing small spacers in accordance with the present invention.

FIG. 3 shows a section of a sock 20′ constructed in accordance with the present invention and having an alternative feature from the embodiment shown in FIGS. 1 and 2. Small spacers 40 (or spacing means) are inserted through holes in each layer 30, 32, and 34 of the material. The purpose of the spacers 40 is to keep the layers of material slightly separated from each other so that the wearer's feet can breathe better. The spacers 40 can be made of any suitable material such as plastic, but soft rubber is the preferred material since rubber's compressibility will make it easier to position through the holes in the material. Rubber spacers 40 will also not be uncomfortable to be stepped on since they will compress. A spacer 40 made of a harder material which does not compress (or compress as much as rubber) will probably irritate the wearer.

Figure 4:
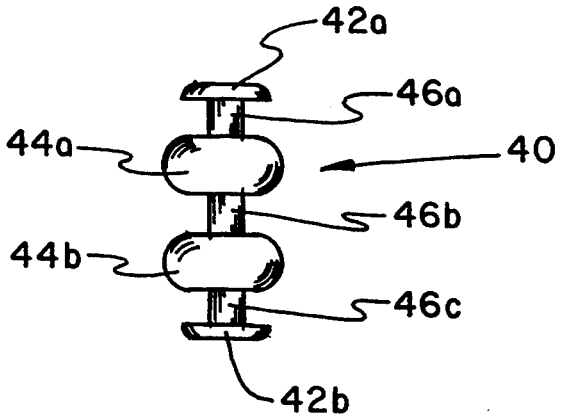
FIG. 4 is a perspective view in elevation of a spacer like that used in the second preferred embodiment of FIG. 3 in accordance with the present invention.

The preferred embodiment of the spacer 40, as shown in FIG. 3 and in more detail in FIG. 4, is comprised of a first end piece 42*a* and an opposite end piece 42*b*. Between the two end pieces 42*a* and 42*b* are two middle pieces 44*a* and 44*b* (first middle piece 44*a* and second middle piece 44*b*). End piece 42*a* is separated from first middle piece 44*a* by means of first spacing section 46*a*. The two middle pieces 44*a* and 44*b* are separated by second spacing section 46*b*. The second middle piece 44*b* is separated from end piece 42*b* by means of third spacing section 46*c*. By using the spacers 40 a little bit of clearance can be maintained between the layers. By increasing the number of spacers 40 used the continuity of the clearance can be maintained.

Figure 5:
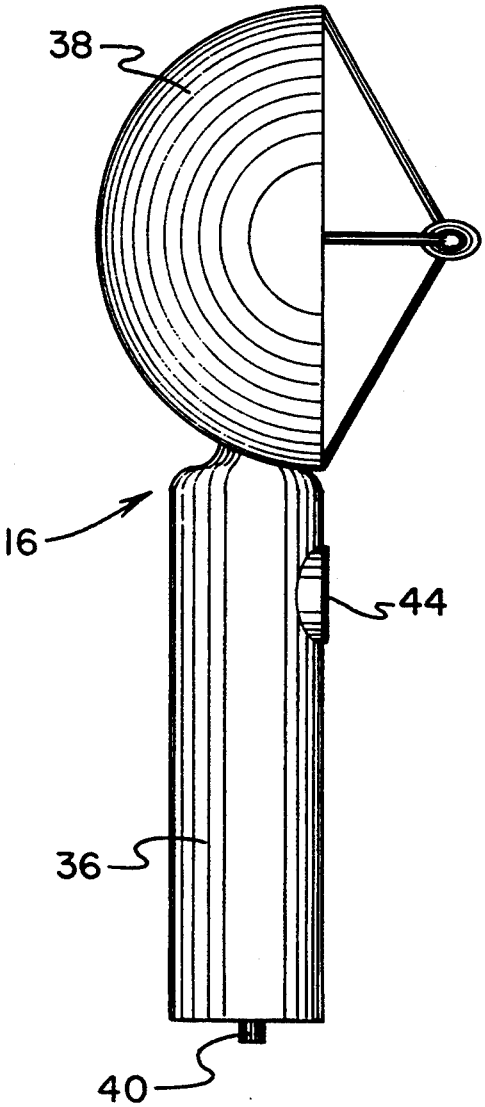
FIG. 5 is a perspective view of a second embodiment of a spacer in accordance with the present invention.
Figure 6:
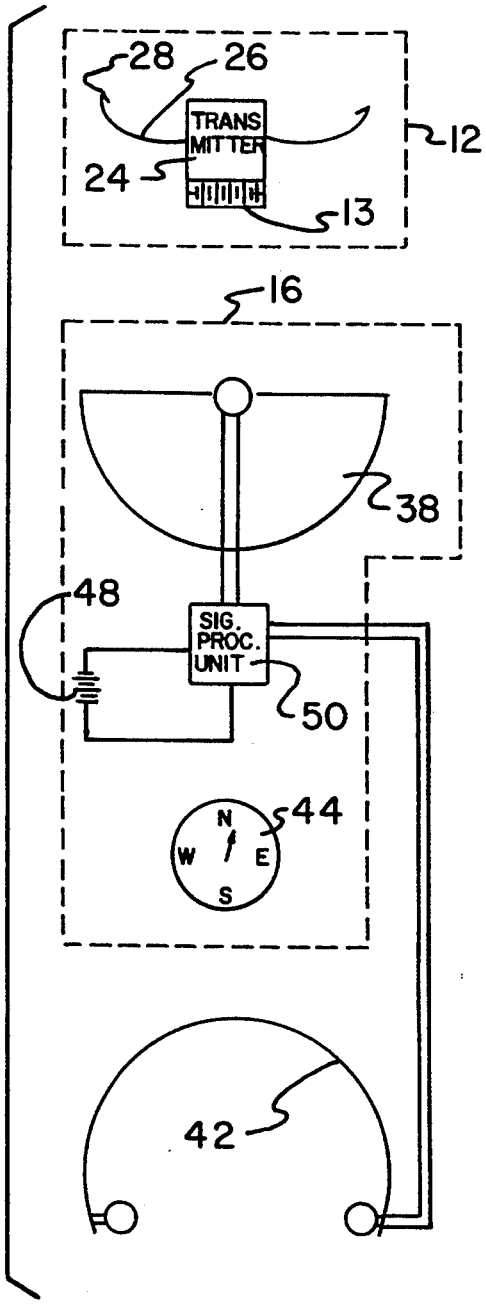
FIG. 6 is a perspective view of the embodiment of the spacer shown in FIG. 5 separated into individual pieces in accordance with the present invention.

An alternative embodiment of a spacer 140 which can be separated into smaller parts is shown in FIG. 5 (parts together) and FIG. 6 (parts separated). The alternative embodiment spacer 140 is comprised of four main parts: a first end piece 142*a*; a second end piece 142*b*; a first middle piece 144*a*; and a second middle piece 144*b*. A first spacing prong 146*a* extends from the first middle section 144*a*. A second spacing prong 146*b* extends from the second middle section 144*b*. A third spacing prong 146*c* extends from the second end piece 142*b*. A first socket 148*a* having a receiving hole 152*a* is located on the first end piece 142*a*. A second socket 148*b* having a receiving hole 152*b* is located on the first middle section 144*a*. A third socket 148*c* having a receiving hole 152*c* is located on the second middle section 144*b*. A first securing ball 150*a* adapted to be securable within receiving hole 152*a* is located on prong 146*a*. A second securing ball 150*b* adapted to be securable within receiving hole 152*b* is located on prong 146*b*. A third securing ball 150*c* adapted to be securable within receiving hole 152*c* is located on prong 146*c*.

The second embodiment of the spacer 140 can be easily put together by securing the securing balls 150*a*, 150*b* and 150*c* to their respective receiving holes 152*a*, 152*b*, and 152*c*.

The water resistant sock of the present invention will keep the wearer's feet warm and dry in wet and/or cold conditions and will also allow the wearer's feet to breathe. The socks will be particularly beneficial to kids who often don't want to wear rubber boots but instead want to wear their regular tennis shoes. By using the socks of the present invention the kids can wear their regular shoes and while their parents can relax knowing that their children's feet are warm and dry. Adults can wear the sock of the present invention to work since it can be made to look just like a regular sock.

It is apparent from the above that the present invention accomplishes all of the objectives set forth by providing a new sock comprised of a layer of water resistant material and an inner layer of non water resistant material. The sock can also have an outer layer of non water resistant material. The inner layer of non water resistant material and said outer layer of non water resistant material can be made of a material socks are commonly made from, such as cotton, wool, polyester, blends of cotton and wool, blends of cotton and polyester, blends of wool and polyester, and blends of cotton, wool, and polyester. At least one, and preferably a plurality, spacing means for separating the layers from each other can be used with the present invention. The spacing means can be made of of soft rubber. The layer of water resistant material can be made of GORE-TEX material.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A sock comprising:

an inner layer of non-water resistant material shaped to receive a foot of an individual;

a middle layer of water-resistant material coextensive with and coupled to an exterior surface of said inner layer;

an outer layer of non-water resistant material coextensive with and coupled to an exterior of said middle layer; and, a plurality of spacer members interposed between said inner and middle layers and between said middle and outer layers for coupling said layers together and retaining said layers in a spaced relationship so as to define an air gap between each of said layers.

2. The sock as recited in claim 1, wherein said layers are removably coupled together by said spacer members.

3. A sock comprising:

an inner layer of non-water resistant material shaped to receive a foot of an individual;

a middle layer of water-resistant material coextensive with and coupled to an exterior surface of said inner layer;

an outer layer of non-water resistant material coextensive with and coupled to an exterior of said middle layer; and, a plurality of spacer members interposed between said layers for coupling said layers together and retaining said layers in a spaced relationship, said spacer members each comprising a substantially planar first end piece having an end piece diameter with a substantially cylindrical first spacing section extending orthogonally from a planar surface of said first end piece, said first spacing section having a spacing section diameter substantially less than said end piece diameter; a first middle piece having opposed planar surfaces mounted to said first spacing section at one of said planar surfaces of said first middle piece, said first middle piece being spaced from and substantially parallel to said first end piece, said first middle piece having a middle piece diameter substantially greater than said end piece diameter; a second spacing section projecting from another planar surface of said first middle piece, said second spacing section having a diameter substantially equal to said spacing section diameter; a second middle piece having opposed planar surfaces mounted to said second spacing section at one of said planar surfaces of said second middle piece, said second middle piece being spaced from and substantially parallel to said first middle piece, said second middle piece having a diameter substantially equal to said middle piece diameter; a third spacing section projecting from another planar surface of said second middle piece, said third spacing section having a diameter substantially equal to said spacing section diameter; and a substantially planar second end piece mounted to said third spacing section, said second end piece being spaced from and substantially parallel to said second middle piece;

wherein said first spacing section extends through an aperture in said inner layer so as to capture said inner layer between said first end piece and said first middle piece, said second spacing section extends through an aperture in said middle layer so as to capture said middle layer between said first middle piece and said second middle piece, and said third spacing section extends through an aperture in said outer layer so as to capture said outer layer between said second middle piece and said second end piece such that said layers are coupled together and retained in a substantially spaced relationship.

4. A sock comprising:

an inner layer of non-water resistant material shaped to receive a foot of an individual;

a middle layer of water-resistant material coextensive with and coupled to an exterior surface of said inner layer;

an outer layer of non-water resistant material coextensive with and coupled to an exterior of said middle layer; and, a plurality of spacer members interposed between said layers for coupling said layers together and retaining said layers in a spaced relationship, said spacer members each comprising a substantially planar first end piece with a substantially cylindrical first socket extending orthogonally from a planar surface of said first end piece, said first socket having a first socket receiving hole; a first spacing prong having a first securing ball, said first securing ball being removably engaged to said first socket within said first socket receiving hole; a first middle piece having opposed planar surfaces mounted to said first spacing prong at one of said planar surfaces of said first middle piece, said first middle piece being spaced from and substantially parallel to said first end piece, said first middle piece having a second socket projecting from another of said planar surfaces of said first middle piece, said second socket having a second socket receiving hole; a second spacing prong having a second securing ball, said second securing ball being removably engaged to said second socket within said second socket receiving hole; a second middle piece having opposed planar surfaces mounted to said second spacing prong at one of said planar surfaces of said second middle piece, said second middle piece being spaced from and substantially parallel to said first middle piece, said second middle piece having a third socket projecting from another of said planar surfaces of said second middle piece, said third socket having a third socket receiving hole; a third spacing prong having a third securing ball, said third securing ball being removably engaged to said third socket within said third socket receiving hole; and a substantially planar second end piece mounted to said third spacing prong, said second end piece being spaced from and substantially parallel to said second middle piece;

wherein said first spacing prong extends through an aperture in said inner layer so as to capture said inner layer between said first end piece and said first middle piece, said second spacing prong extends through an aperture in said middle layer so as to capture said middle layer between said first middle piece and said second middle piece, and said third spacing prong extends through an aperture in said outer layer so as to capture said outer layer between said second middle piece and said second end piece such that said layers are coupled together and retained in a substantially spaced relationship.

* * * * *